US006076574A

United States Patent [19]

Fadyk

[11] Patent Number: 6,076,574

[45] Date of Patent: Jun. 20, 2000

[54] MACHINE FOR SHAPING CURVED MOLDING

[76] Inventor: Michael W. Fadyk, 101 Landrigan Street, Arnprior, Ontario, Canada, K7S 2S7

[21] Appl. No.: 09/349,109

[22] Filed: Jul. 8, 1999

[51] Int. Cl.[7] ..... B27C 5/00

[52] U.S. Cl. ..... 144/134.1; 142/13; 144/2.1; 144/137; 144/139; 144/154; 144/218; 144/241; 144/363

[58] Field of Search ..... 142/3, 7, 8, 13, 142/22, 36; 144/2.1, 134.1, 134.2, 134.3, 136.1, 363, 218, 241, 137, 139, 154

[56] References Cited

U.S. PATENT DOCUMENTS 3,215,175 11/1965 Hibner ..... 144/154
5,161,589 11/1992 De Biagio ..... 144/134.1

*Primary Examiner*—W. Donald Bray
*Attorney, Agent, or Firm*—George A. Seaby

[57] ABSTRACT

A machine for shaping curved wooden molding includes an arbor mounted on a housing for receiving a cylindrical workpiece formed from four lengths of curved molding blanks, a drive for rotating the arbor, and a pivot arm carrying a blade at the top end thereof for movement towards and away from a workpiece mounted on the arbor, whereby, when the top end of the pivot arm is rotated towards the arbor, the blade engages the rapidly rotating workpiece to shape the latter.

9 Claims, 6 Drawing Sheets

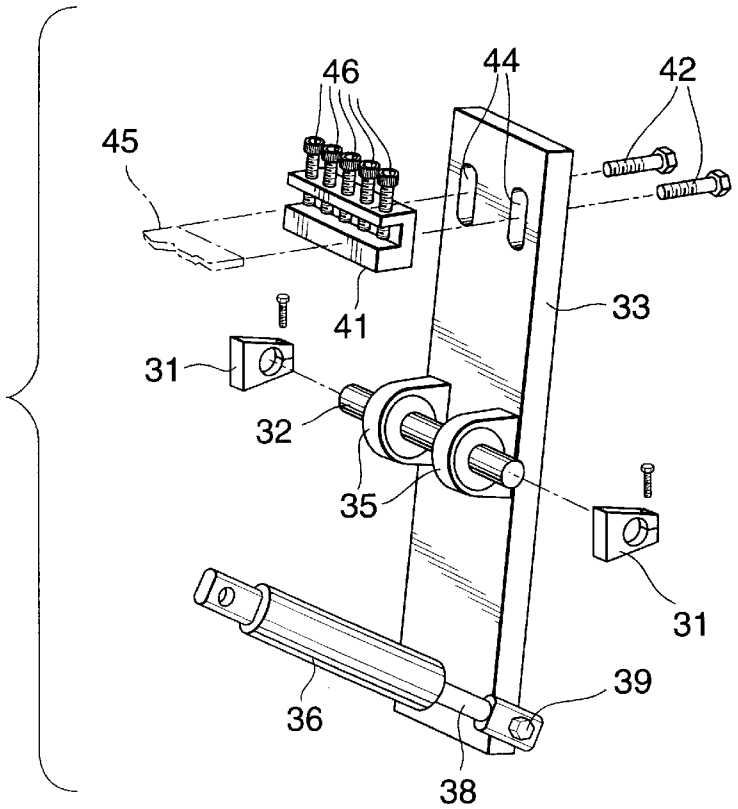
FIG. 5
FIG. 4
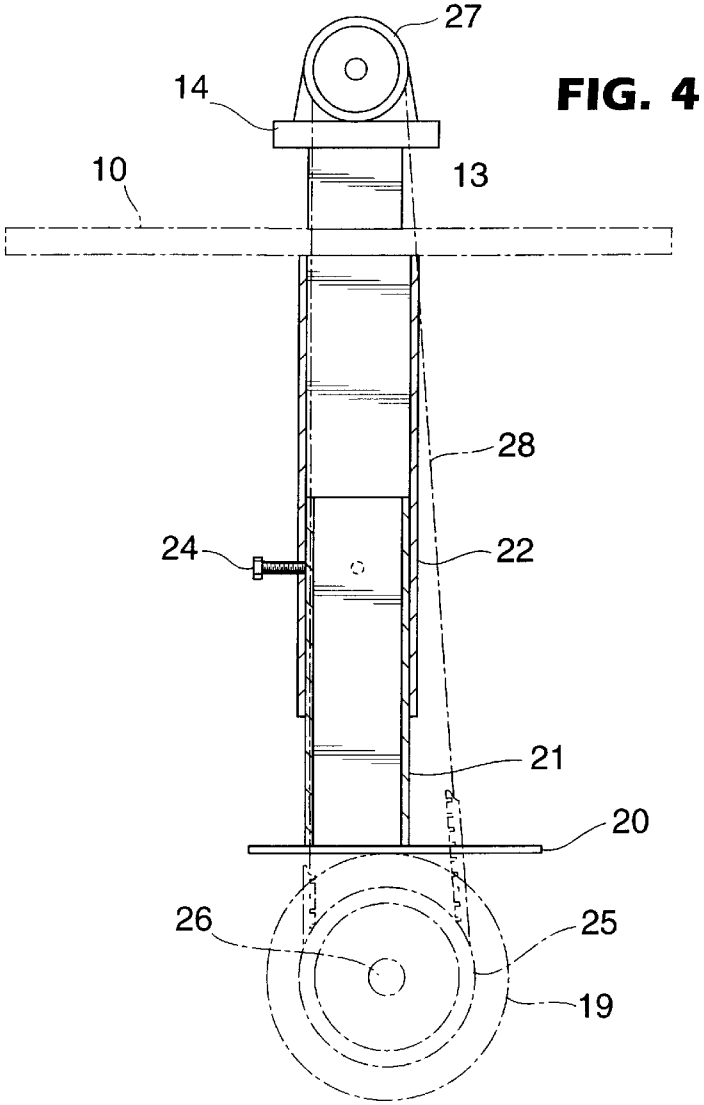

MACHINE FOR SHAPING CURVED MOLDING

BACKGROUND OF THE INVENTION

1. Field of the Invention

This invention relates to a machine for shaping wooden curved corner molding.

2. Discussion of the Prior Art

Recently, it has become increasingly common to use soft or rounded corners as opposed to sharp, right angle corners in new dwellings. The use of soft corners has given rise to the problem of extending baseboard or chair rail molding around the corner. With square corners, it is merely necessary to make a miter joint at outside corners. There is also the problem of ensuring that the curved corner molding, i.e. the piece of molding extending around the corners is the same thickness as the adjacent straight sections of molding. One solution to these problems is to use a hydraulic tracer lathe to cut the curved molding. However, such lathes can be expensive and the cutting process is complicated. Moreover, it is difficult to accurately duplicate the profiles of the straight lengths of molding, and sanding is required to yield a satisfactory finished product.

GENERAL DESCRIPTION OF THE INVENTION

An object of the present invention is to provide a solution to the above mentioned problems in the form of a relatively simple machine for shaping curved, wooden corner molding quickly and accurately.

Another object of the invention is to provide a machine of the above defined type which yields a finished product, which does not require sanding or other finishing operations.

Accordingly, the invention relates to a machine for shaping a curved workpiece comprising a frame, an arbor mounted on said frame for receiving a cylindrical workpiece; a drive for rotating said arbor; a pivot arm rotatably mounted on said frame for moving one end of the arm towards and away from said arbor and a workpiece mounted thereon; and a blade holder on said arm for carrying a blade, whereby, when the pivot arm is rotated towards said arbor, the blade engages said workpiece to cut and consequently shape the workpiece.

BRIEF DESCRIPTION OF THE DRAWINGS

The invention is described in greater detail with reference to the accompanying drawings, which illustrate a preferred embodiment of the invention, and wherein:

FIG. 4 is a side view of a drive assembly for use in the machine of FIG. 1;

FIG. 5 is an exploded isometric view of a pivot arm used in the machine of FIG. 1;

DESCRIPTION OF THE PREFERRED EMBODIMENT

Figure 1:
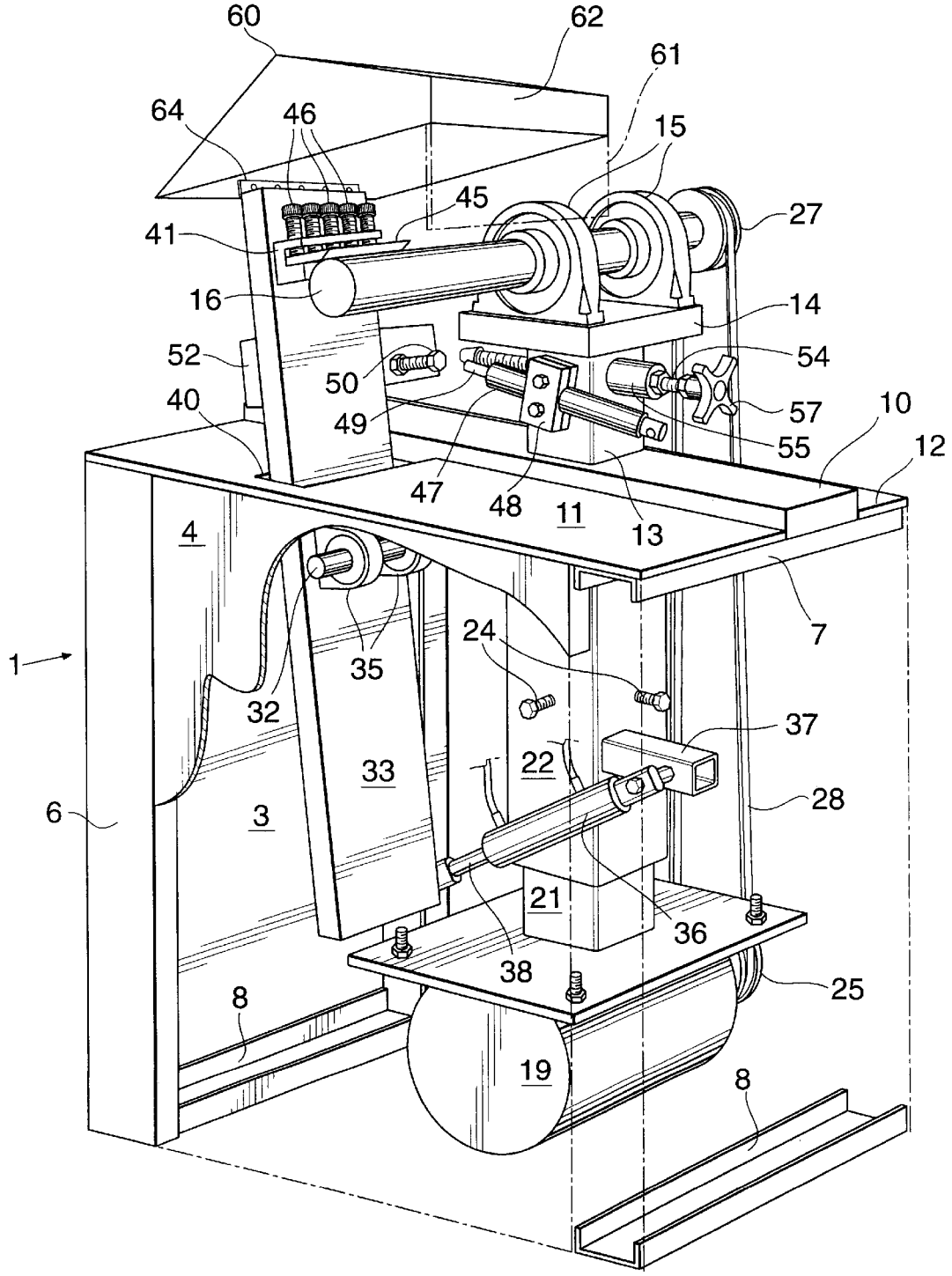
FIG. 1 is a partly sectioned, perspective view of a machine for shaping curved molding in accordance with the present invention.

Referring to the drawings, the machine for shaping curved corner molding includes a housing generally indicated at 1 in the shape of a rectangular parallelepiped. The housing 1 is defined by front and rear walls 2 and 3, respectively, and side walls 4 (one shown). The ends of the front and rear walls 2 and 3 are bent to define corner posts 6. Top and bottom crossbars 7 and 8, respectively defined by C-shaped channel members extend between the corner posts 6 to lend rigidity to the housing.

Figure 2:
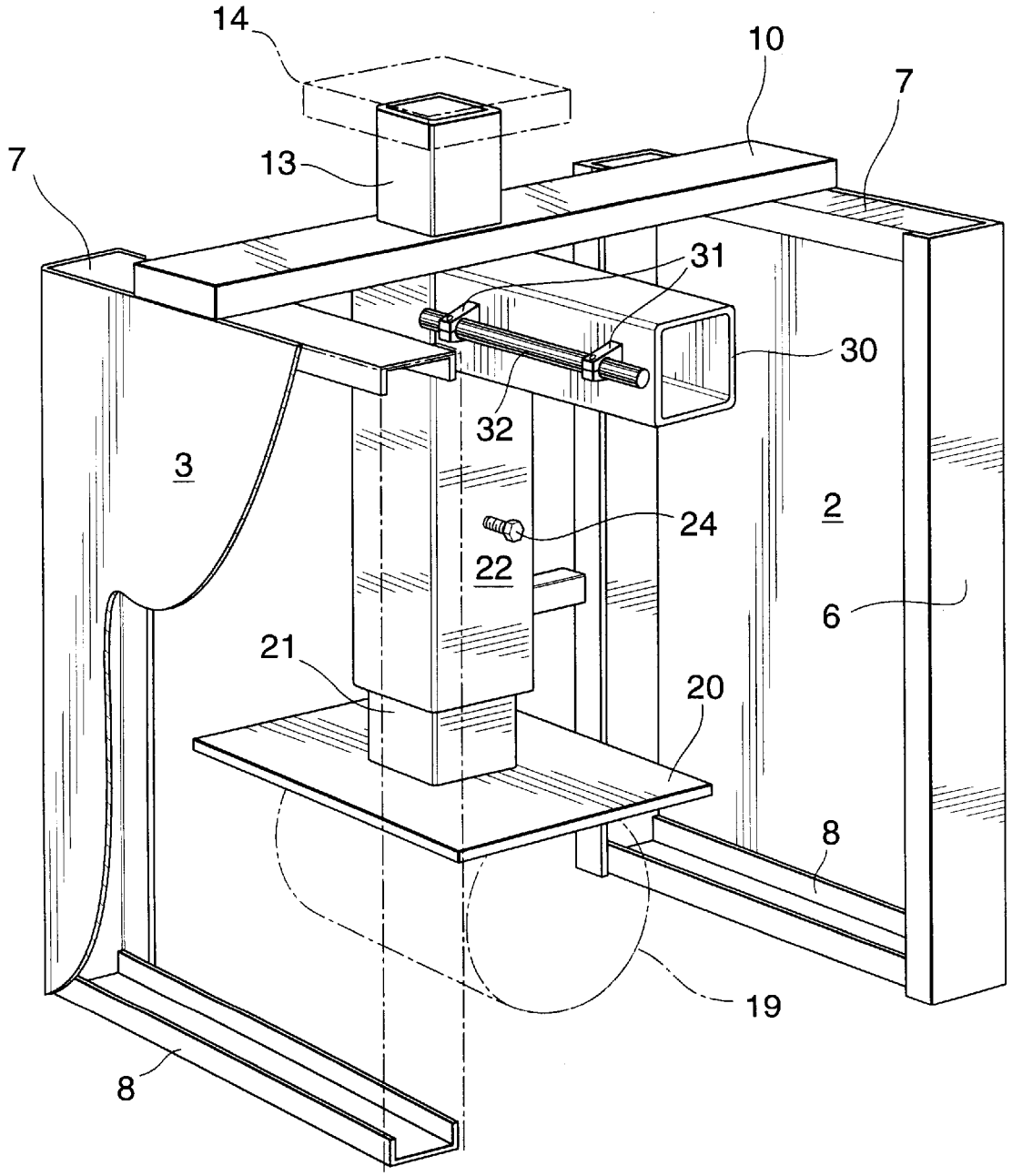
FIG. 2 is a partly sectioned, perspective view of a frame and a portion of the housing of the machine of FIG. 1.
Figure 7:
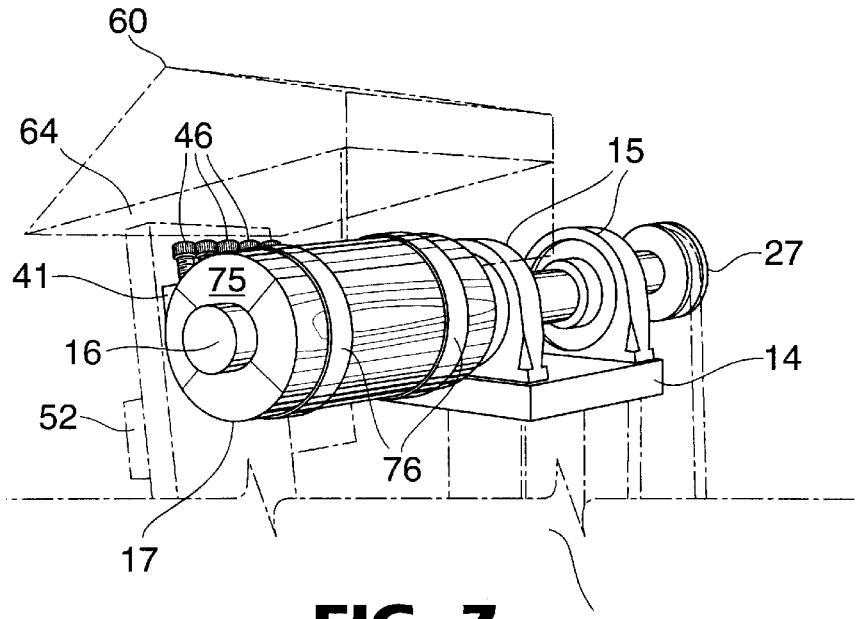
FIG. 7 is a perspective view of the workpiece and the top end of the machine of FIG. 1 at the start of a shaping operation.

A top bar 10 extends between the front and rear top crossbars 7. The remainder of the top of the housing is closed by top plates 11 and 12. The top bar 10 forms part of a frame supported by the front and rear crossbars 7 of the housing. The frame supports all of the working elements of the machine. As best shown in FIG. 2, as well as the top bar 10, the frame incudes a short post 13 mounted on the top bar 10. A plate 14 on the upper end of the post 13 carries a pair of pillow block bearings 15, which carry an arbor or shaft 16 for carrying a wooden workpiece 17 (FIG. 7) for shaping in a manner described hereinafter in greater detail.

The arbor 16 is rotated at approximately 4,000 rpm by an electric motor 19 mounted on the bottom of a plate 20, which is connected to the lower end of a square cross section tube 21. The tube 21 is slidably mounted in the bottom end of a larger square cross section tube 22, the top end of which is welded to the top bar 10 beneath the post 13. The tube 21 is releasably locked in one position by a pair of bolts 24.

A pulley 25 mounted on the shaft 26 (FIG. 4) of the motor 19 is connected to a pulley 27 on the outer end of the arbor 16 by a belt 28. When assembling the machine, the belt 28 is placed on the pulleys 25 and 27 with the tube 21 in an elevated position. With the bolts 24 loose, the tube 21 and the motor 19 are lowered to tension the belt 28, and the bolts 24 are tightened to lock the tube 21 in a fixed position in the tube 22.

A horizontal arm 30 (FIG. 2) defined by a length of square cross section extends outwardly from the top end of the vertical tube 22 to one side wall 4 of the housing. The arm 30 carries a pair of spaced apart brackets 31, which fixedly support a shaft 32. An inclined pivot arm 33 is rotatably mounted on the shaft 32 by means of a pair of pillow block bearings 35, which are secured to the arm 33 between the brackets 31.

The pivot arm 33 is rotated by a pneumatic cylinder 36, one end of which is pivotally connected to an arm 37 extending forwardly from the tube 22. The free end of a piston rod 38 extending downwardly from the other end of the cylinder 36 is pivotally connected to the lower end of the arm 33 by a bolt 39 (FIG. 5) for rotating the arm around the longitudinal axis of the shaft 32. The arm 33 extends upwardly through a slot 40 in the top plate 11. A blade holder 41 is mounted on the upper end of the arm 33 at approximately the same height as the arbor 16. Bolts 42 extend through slots 44 (FIG. 5) in the arm 33 into the back of the holder 41. The slots 44 make it possible to adjust the vertical position of the holder 41 on the arm 33. The blades 45 used in the machine are the same blades as used in the machine for shaping straight molding, i.e. the blades used to cut straight lengths of molding are transferred from the molding shaper to the holder 41. Thus, the profile of the curved molding is identical to that of the straight lengths of molding.

The cylinder 36 moves a blade 45 towards and away from a workpiece 17 mounted on the arbor 16. As the blade approaches the workpiece 17, the speed of movement of the blade is controlled, i.e. reduced by a hydraulic, speed control cylinder 47 mounted in a bracket 48 (FIG. 1) on one side of the post 13. The cylinder 47 functions like a shock absorber, including a pin 49 extending outwardly therefrom into the path of travel of the head of a bolt 50 mounted on a horizontal arm 52 extending outwardly from the pivot arm 33. The speed control cylinder 47 ensures that, during cutting, the blade 45 moves slowly into the workpiece 17. The position of the cylinder 47 in the bracket 48 can be adjusted to change the point where the speed control comes into play, i.e. to accommodate workpieces 17 of different thicknesses.

The depth of cut is dictated by an adjustable stop defined by a threaded rod or elongated bolt 54 mounted in an internally threaded sleeve 55 on the front side of the post 13, whereby the depth of cut can be adjusted to accommodate moldings of different thicknesses. A knob 57 on the front end of the rod 54 is used to rotate the latter, i.e. to adjust the point of closest approach of the blade 45 to the arbor 16. A rubber tip 58 on the other end of the rod 54 results in a smooth, rather than an abrupt stop to produce a smooth molding which does not require sanding. When the blade 45 approaches the arbor 16, the tip 58 engages the arm 52 to stop the pivot arm 33 and the blade 45.

Figure 3:
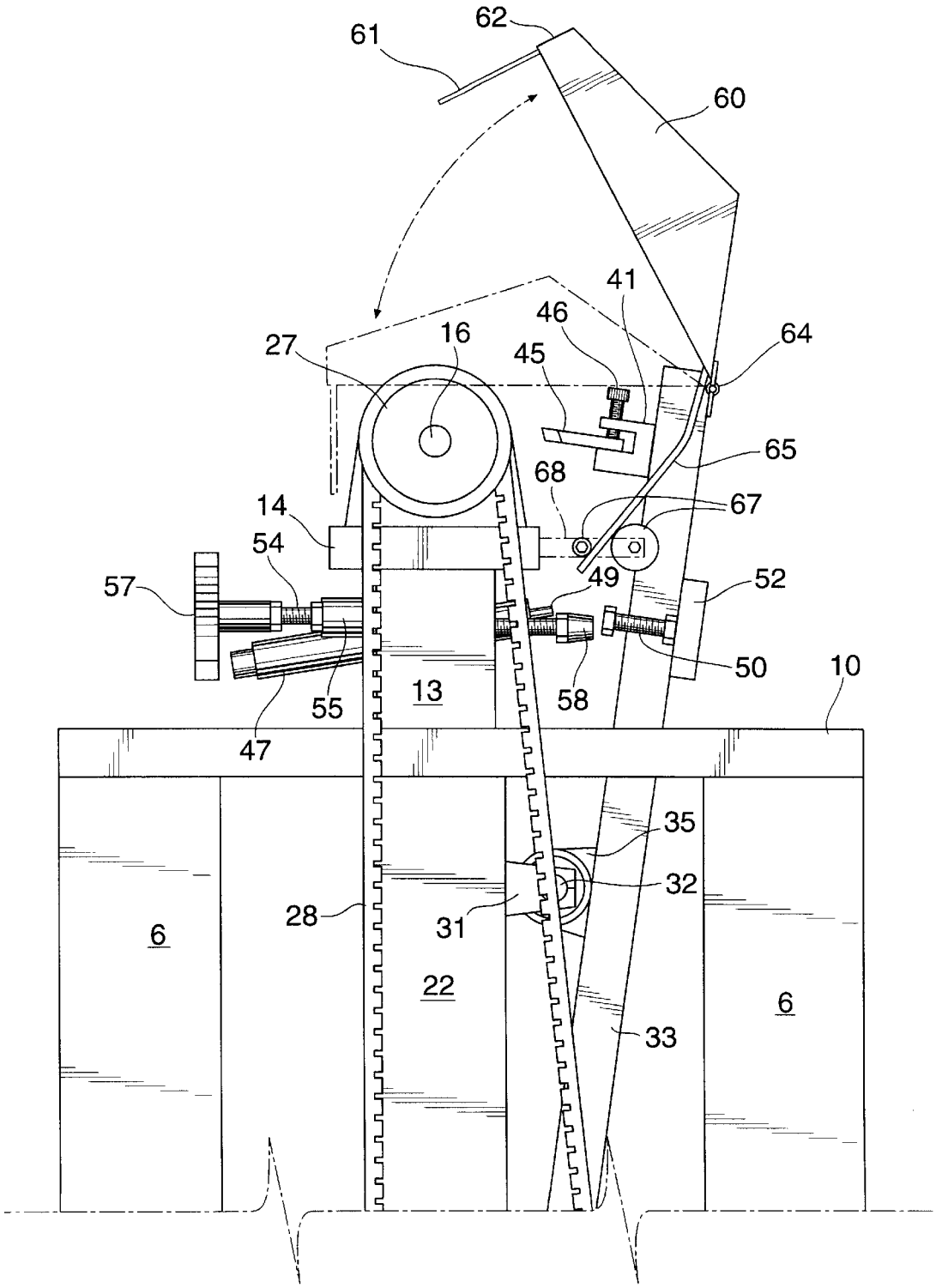
FIG. 3 is a side view of the top of the machine of FIG. 1, with parts omitted.

During cutting, the machine operator is protected from flying wood particles by a hood 60 and a clear plastic window 61 extending downwardly from the front end 62 of the hood. The rear end of the hood 60 is pivotally connected to the top end of the arm 33 by a piano hinge 64. A lever 65 (FIG. 3) extends downwardly from the rear, hinge end of the hood 60 between a pair of spaced apart rollers 67. The rollers 67 are mounted on the free end of an arm 68 extending rearwardly form the plate 14. When the blade 45 and the top end of the arm 33 move forwardly, the lever 65 pivots the rollers 67 causing the hood 60 to pivot from the raised non-use position (shown in solid lines in FIG. 3) to the lower, use position (shown in solid lines in FIG. 1 and phantom outline in FIGS. 3 and 7).

Figure 6:
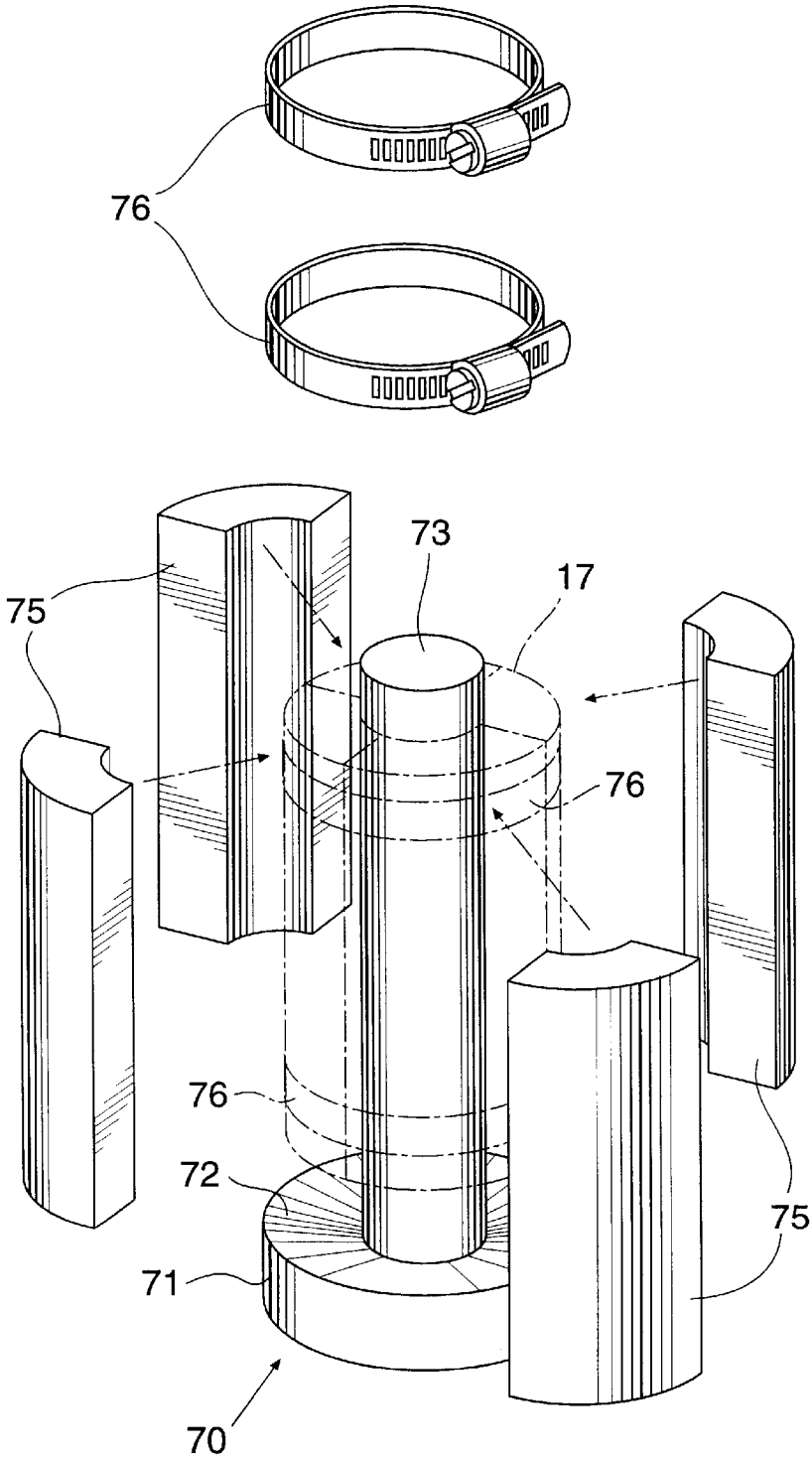
FIG. 6 is an exploded view of a mandrel for preparing a workpiece for shaping in the machine of FIG. 1.

Referring to FIG. 6, a mandrel generally indicated at 70 is used to assemble a workpiece 17. The mandrel 70 includes a disc-shaped base 71 with a slightly concave top surface 72. A post 73 with roughly the same diameter is the arbor 16 is mounted in the center of the top surface 72. When assembling a workpiece 17, four blanks, i.e. pieces 75 of curved corner molding are placed on the mandrel 70 to form a cylinder, and gear clamps 76 are placed around the top and bottom of the cylinder. The clamps 76 are tight enough to hold the blanks 75 in position, but loose enough to permit removal from the post 73. The workpiece 17 is slid from the post 73 and placed on the arbor 16, and the clamps 76 are tightened.

Figure 8:
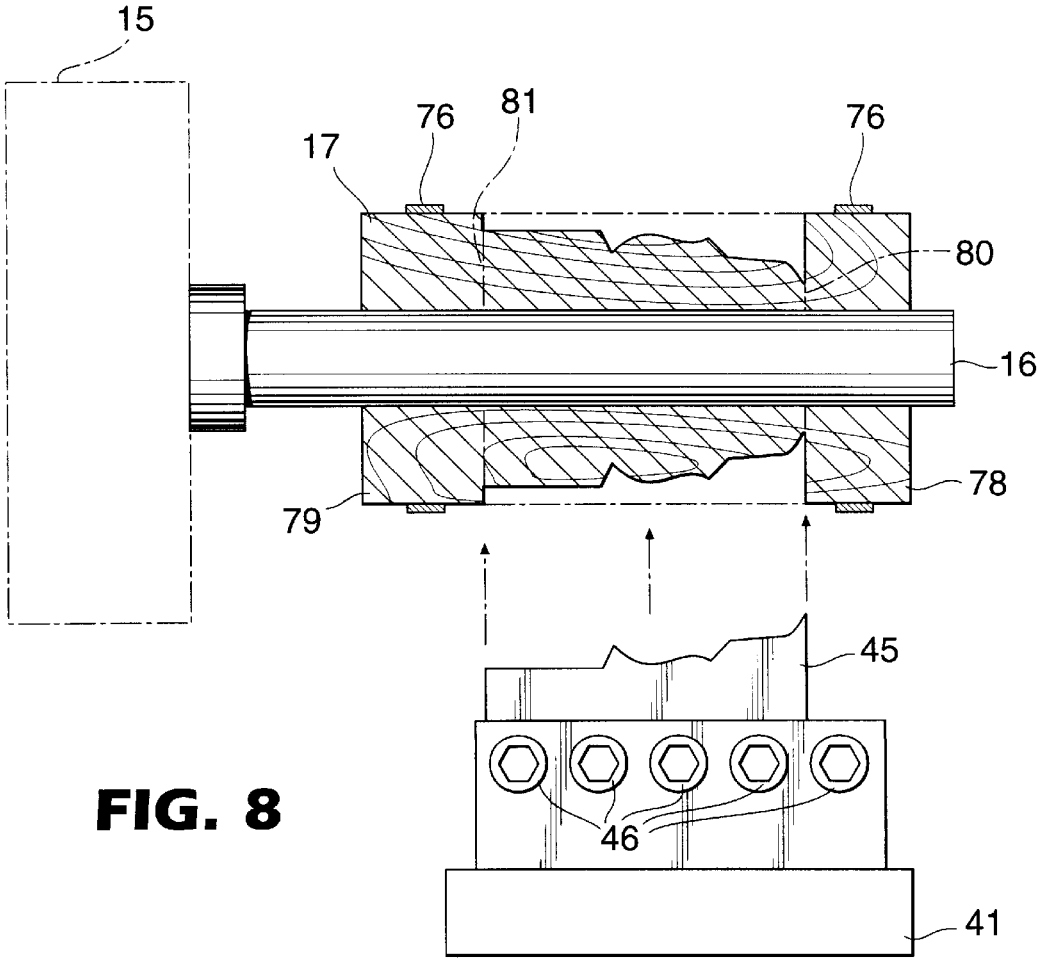
FIG. 8 is a longitudinal sectional view of a workpiece during a shaping operation.

The motor 19 is actuated to cause the workpiece 17 to rotate with the arbor 16. Actuation of the cylinder 36 causes the arm 33 to rotate the blade 45 towards the workpiece 17. When the blade 45 is almost touching the workpiece 17, the head of the bolt 50 engages the pin 49 which slows down the speed of approach of the blade 45. The blade 45 continues to move towards the workpiece 17 to shape the molding (FIG. 8) until the tip 58 of the threaded rod 54 encounters the arm 52. As mentioned above, the use of a rubber tip 58 on the rod 54 ensures a smooth stop, and the resulting product does not require sanding. The clamps 76 are loosened slightly to permit removal of the workpiece from the arbor 16. The ends 78 and 79 of the workpiece are removed by cutting along lines 80 and 81 leaving four pieces of curved molding with the desired profile on the outer surface thereof.

I claim:

1. A machine for shaping a curved workpiece comprising a frame, an arbor mounted on said frame for receiving a cylindrical workpiece; a drive for rotating said arbor; a pivot arm rotatably mounted on said frame for moving one end of the arm towards and away from said arbor and a workpiece mounted thereon; and a blade holder on said arm for carrying a blade, whereby, when the pivot arm is rotated towards said arbor, the blade engages said workpiece to cut and consequently shape the workpiece.

2. The machine of claim 1, including a speed control for controlling the speed of approach of the blade towards the arbor during cutting of the workpiece.

3. The machine of claim 2, including an adjustable stop for limiting movement of the blade towards said arbor, and consequently the depth of cut.

4. The machine of claim 3, including rectangular housing carrying said frame, said housing comprising side and end walls and a top bar extending between said end walls supporting said frame.

5. The machine of claim 4, wherein said frame includes a post on said top bar carrying said arbor, and telescopically interconnected tubes dependent from top bar.

6. The machine of claim 3, wherein said adjustable stop includes a stop arm extending outwardly from said pivot arm; and a threaded rod mounted in said post for engaging said stop arm when the blade approaches the arbor.

7. The machine of claim 6, wherein said speed control includes a hydraulic cylinder on said post, a piston rod extending outwardly from said cylinder towards said stop arm; and a bolt on said stop arm for engaging said piston rod during movement of the blade towards said workpiece and arbor.

8. The machine of claim 5, wherein said drive includes a motor dependent from said telescopically interconnected tubes, said motor having a shaft extending outwardly therefrom, pulleys on said arbor and said shaft, and a belt extending around said pulleys, the tubes permitting adjustment of the tension on said belt.

9. The machine of claim 8, wherein said telescopically interconnected tubes include a top tube connected to said top bar, and a bottom tube carrying said motor slidable in the bottom end of said top tube for adjusting the tension on said belt.

* * * * *